US010557282B1

(12) United States Patent
Flannery et al.

(10) Patent No.: US 10,557,282 B1
(45) Date of Patent: Feb. 11, 2020

(54) STICKLESS EXTERIORLY OPERATED UMBRELLA CANOPY

(71) Applicant: Regalo International, LLC, Longboat Key, FL (US)

(72) Inventors: Mark A. Flannery, Longboat Key, FL (US); Brian M. McMahon, Palatine, IL (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 15/863,461

(22) Filed: Jan. 5, 2018

Related U.S. Application Data

(60) Provisional application No. 62/443,705, filed on Jan. 7, 2017.

(51) Int. Cl.

| | |
|---|---|
| ***E04H 15/28*** | (2006.01) |
| ***A47L 13/06*** | (2006.01) |
| ***E04H 15/02*** | (2006.01) |
| ***A47C 29/00*** | (2006.01) |

(52) U.S. Cl.
CPC ..... *E04H 15/28* (2013.01); *A47C 29/003* (2013.01); *A47L 13/06* (2013.01); *E04H 15/02* (2013.01)

(58) Field of Classification Search
CPC ..... E04H 15/48; E04H 15/44; E04H 15/28; E04H 15/36; E04H 15/58; E04H 15/02; A47C 29/003; A47C 29/006; A47D 13/06; A47D 13/063; A47D 7/02
USPC ..... 135/90, 98, 135, 147, 159, 905, 96; 5/97, 93.1, 112–113, 414–415
See application file for complete search history.

(56) References Cited

U.S. PATENT DOCUMENTS

| | | | | |
|---|---|---|---|---|
| 481,014 | A | 8/1892 | Duncan | |
| 998,462 | A | 7/1911 | Burch | |
| 1,823,386 | A | 9/1931 | Brust | |
| 2,530,765 | A | 11/1950 | Greenup | |
| 2,771,087 | A * | 11/1956 | Simonson | E04H 15/28 135/126 |
| 2,864,389 | A * | 12/1958 | Smith | E04H 15/28 135/120.2 |
| 2,948,287 | A | 8/1960 | Rupert | |
| 3,269,398 | A | 8/1966 | Holbitz | |
| 3,738,378 | A | 6/1973 | Williams | |

(Continued)

FOREIGN PATENT DOCUMENTS

| | | |
|---|---|---|
| AU | 2004202193 A1 | 6/2004 |
| CN | 100449099 | 1/2009 |

(Continued)

OTHER PUBLICATIONS buyshade.com, Custom Dome II, www.buyshade.com/custom-tents/custom-dome/, three pages, accessed on Feb. 14, 2017.

(Continued)

*Primary Examiner* — Winnie Yip

(57) ABSTRACT

An umbrella canopy that opens and closes not from a stick from within the interior of the umbrella canopy but from the exterior crown where a line is pulled to open the umbrella canopy and where a button is pushed to close the umbrella canopy. The interior of the umbrella canopy includes no stick to hold up the umbrella canopy. Taut edges of the umbrella canopy hold up the umbrella canopy, for instance, on the top edges of a playyard.

15 Claims, 6 Drawing Sheets

(56) References Cited

U.S. PATENT DOCUMENTS

| | | | | |
|---|---|---|---|---|
| 3,794,054 | A | 2/1974 | Watts | |
| 3,874,397 | A | 4/1975 | Oberhaus | |
| 4,033,366 | A | 7/1977 | Forget | |
| 4,131,954 | A | 1/1979 | Brock et al. | |
| 4,148,102 | A * | 4/1979 | Ying-Yu | A42B 1/206 135/96 |
| 4,202,363 | A | 5/1980 | Watts et al. | |
| 4,790,340 | A | 12/1988 | Mahoney | |
| 5,216,948 | A * | 6/1993 | Sheppard | A21D 8/04 126/281 |
| 5,333,634 | A | 8/1994 | Taylor | |
| 5,479,954 | A | 1/1996 | Lin | |
| 5,611,364 | A | 3/1997 | Woods et al. | |
| D382,618 | S | 8/1997 | Gift | |
| 5,871,026 | A * | 2/1999 | Lin | E04H 15/28 135/120.3 |
| 6,021,795 | A | 2/2000 | Long | |
| 6,119,288 | A | 9/2000 | Hendrickson | |
| 6,148,455 | A | 11/2000 | Kasem | |
| 6,199,572 | B1 | 3/2001 | Rousselle et al. | |
| 6,230,728 | B1 | 5/2001 | Reese | |
| 6,345,639 | B2 | 2/2002 | Rousselle et al. | |
| 6,354,004 | B1 | 3/2002 | Worsham | |
| 6,802,329 | B2 * | 10/2004 | Chen | E04H 15/48 135/135 |
| 6,854,476 | B1 | 2/2005 | Chai | |
| 7,047,992 | B1 * | 5/2006 | Fluellen | E04H 12/2223 135/136 |
| 7,096,874 | B2 | 8/2006 | Forshpan | |
| 7,185,666 | B2 * | 3/2007 | Chai | E04H 15/425 135/135 |
| 7,290,378 | B2 | 11/2007 | Kalnay | |
| 7,568,243 | B2 | 8/2009 | Gehr | |
| 7,802,582 | B2 | 9/2010 | Livacich et al. | |
| 8,056,572 | B2 | 11/2011 | Livacich et al. | |
| 8,079,176 | B1 | 12/2011 | Thead et al. | |
| 8,418,710 | B2 | 4/2013 | Zhou | |
| 9,144,325 | B1 | 9/2015 | Sousa et al. | |
| D747,001 | S | 1/2016 | Gessford | |
| 9,320,363 | B1 | 4/2016 | Beaver | |
| 2003/0062077 | A1 | 4/2003 | Lin | |
| 2004/0084074 | A1 | 5/2004 | Chiu et al. | |
| 2004/0099301 | A1 | 5/2004 | Zhang et al. | |
| 2004/0159346 | A1 | 8/2004 | Huang | |
| 2006/0037636 | A1 | 2/2006 | Lin | |
| 2006/0162756 | A1 | 7/2006 | Gao | |
| 2006/0231129 | A1 | 10/2006 | Ferraro, Sr. et al. | |
| 2006/0289048 | A1 | 12/2006 | Choi | |
| 2007/0062569 | A1 | 3/2007 | Joo-Tai | |
| 2007/0227571 | A1 | 10/2007 | Youn | |
| 2008/0314427 | A1 | 12/2008 | Lai | |
| 2009/0107973 | A1 | 4/2009 | Pai | |
| 2010/0200038 | A1 | 8/2010 | Roman et al. | |
| 2011/0192438 | A1 | 8/2011 | Chin et al. | |
| 2012/0006371 | A1 | 1/2012 | Livacich et al. | |
| 2013/0074895 | A1 | 3/2013 | Zimmer | |
| 2014/0261603 | A1 * | 9/2014 | Leblanc | E04H 15/28 135/147 |

FOREIGN PATENT DOCUMENTS

| | | | |
|---|---|---|---|
| CN | 104196315 | | 12/2014 |
| EP | 0387965 | A1 | 9/1990 |
| FR | 750895 | A | 8/1933 |
| FR | 859919 | A | 1/1941 |
| FR | 1540516 | A | 9/1968 |
| GB | 677448 | | 8/1952 |
| GB | 732709 | | 6/1955 |
| GB | 760960 | | 11/1956 |
| GB | 2201703 | A | 9/1988 |
| WO | 0023676 | | 4/2000 |

OTHER PUBLICATIONS

Summer Infant, Pop 'n Play Deluxe Ultimate Playard Instruction Manual, two pages, Woonsocket, RI, USA, 2016.

Ware Manufacturing Inc., Deluxe Pop-Up Playpen, Lg, Ware Manufacturing Inc. Date unknown.

* cited by examiner

STICKLESS EXTERIORLY OPERATED UMBRELLA CANOPY

This application claims the benefit under 35 U.S.C. 119(e) of U.S. Provisional Patent Application No. 62/443,705 filed Jan. 7, 2017, which application is hereby incorporated by reference in its entirety into this application.

FIELD OF THE INVENTION

The present invention relates to umbrellas, and more particularly relates to umbrellas that are opened and closed by means other than means disposed under the umbrella canopy.

BACKGROUND OF THE INVENTION

One definition of an umbrella is "a device consisting of a circular canopy of cloth on a folding metal frame supported by a central rod, used as protection against rain or sometimes sun." Another definition of an umbrella is "a light, small, portable, usually circular cover for protection from rain or sun, consisting of a fabric held on a collapsible frame of thin ribs radiating from the top of a carrying stick or handle." A parasol is "a lightweight umbrella used, especially by women, as a sunshade." Golf umbrellas are often sufficiently large to cover a foursome. Pocket umbrellas are small and foldable. An umbrella "crown" is the top or highest part of an umbrella.

A playyard is a structure that may have an endless wall, a floor and a frame. The playyard may be foldable, including the frame, such that the playyard is portable. The playyard may be packed into a car along with camping gear or taken to the local park for a picnic. A golf umbrella may be of sufficient size to fit over a playyard, but the stick of the golf umbrella is an unfortunate structure that would depend into the playyard and interfere with an otherwise safe environment.

SUMMARY OF THE INVENTION

A feature of the present invention is a stickless umbrella canopy.

Another feature of the present invention is an exteriorly operated umbrella canopy.

Another feature of the present invention is a stickless exteriorly operated umbrella canopy.

Another feature of the present invention is the provision in an exteriorly operated umbrella canopy, of an umbrella canopy having an open flexed shape and a closed relaxed shape and of the umbrella canopy having an exterior and interior.

Another feature of the present invention is the provision in an exteriorly operated umbrella canopy, of a first hub having an outer portion on the exterior or crown of the umbrella canopy and an inner portion on the interior of the umbrella canopy.

Another feature of the present invention is the provision in an exteriorly operated umbrella canopy, of a second hub in the interior of the umbrella canopy, where the second hub is drawable to and away from the first hub, and where the second hub is engageable to and disengageable from the first hub.

Another feature of the present invention is the provision in an exteriorly operated umbrella canopy, of a set of at least three long ribs radially extending from the first hub, where each of the long ribs includes a proximal end, a distal end and an intermediate section therebetween, where each of the proximal ends of the long ribs is pivotally engaged to the first hub, where the long ribs include a flexed state when the umbrella canopy is in the open flexed shape and a relaxed state when the umbrella canopy is in the closed relaxed shape.

Another feature of the present invention is the provision in an exteriorly operated umbrella canopy, of a set of at least three short ribs radially extending from the second hub, where each of the short ribs includes a proximal end and a distal end, where each of the proximal ends of the short ribs is pivotally engaged to the second hub, and where each of the distal ends of the short ribs is pivotally engaged to the intermediate section of one of said long ribs.

Another feature of the present invention is the provision in an exteriorly operated umbrella canopy, of a flexible cover engaged to the long ribs and extending generally from the first hub to generally the distal ends of the long ribs, where the flexible cover includes generally a concave taut state when the long ribs are in the flexed state and a folded loose state when the long ribs are in the relaxed state.

Another feature of the present invention is the provision in an exteriorly operated umbrella canopy, of a line having a proximal end and a distal end, where the distal end of the line is engaged to the second hub, where the line extends through the first hub, where the proximal end of the line is disposed outside the interior of the umbrella canopy such that the proximal end of the line can be pulled to i) draw the second hub in the direction of the first hub such that the short ribs push against the long ribs and place the long ribs into the flexed state and ii) further draw the second hub in the direction of the first hub until the second hub engages the first hub to lock the long ribs in the flexed state and the flexible cover in the concave taut state.

Another feature of the present invention is the provision in an exteriorly operated umbrella canopy, of the first hub including a button accessible from the exterior of the umbrella canopy, where the button is depressible to disengage the second hub from the first hub, whereupon the long ribs unflex and push the short ribs and second hub away from the first hub and such that the flexible cover collapses from the concave taut shape to the folded loose state.

Another feature of the present invention is the provision in an exteriorly operated umbrella canopy, of the flexible cover including a set of cover sections, where each of the sections includes first and second edges defined by adjacent long ribs, where each of the sections includes a distal edge running between the distal ends of the adjacent long ribs, and where the distal edges of the sections define a plane when the flexible cover is in the concave taut shape.

Another feature of the present invention is the provision in an exteriorly operated umbrella canopy, of the flexible cover including an inner peripheral edge, where the inner peripheral edge defines a plane when the flexible cover is in the concave taut shape.

Another feature of the present invention is the provision in an exteriorly operated umbrella canopy, of a set of flaps, where each of the flaps is engaged to the inner peripheral edge of the flexible cover between two distal ends of two respective adjacent long ribs and extends beyond the inner peripheral edge of the flexible cover to define an outer periphery, and where each of the flaps is in a relaxed and nontaut state both when the flexible cover is in the concave taut state and when the flexible cover is in the folded loose state.

Another feature of the present invention is the provision in an exteriorly operated umbrella canopy, of the second hub including a first portion and a second portion, where the first portion is adjacent to the first hub when the first and second hubs are engaged, where the second portion is opposite of the first portion, where the second portion is coaxial with the line when the flexible cover is in the concave taut state, where the second portion is an under face of the second hub, and where the under face is free of a stick.

Another feature of the present invention is the provision in an exteriorly operated umbrella canopy, of one of the first and second hubs including an integral shaft that is coaxial with the first and second hubs, where the line runs through the integral shaft.

Another feature of the present invention is the provision in an exteriorly operated umbrella canopy, of the covering including netting.

Another feature of the present invention is the provision in an exteriorly operated umbrella canopy, of the covering including a portion that is water resistant.

Another feature of the present invention is the provision in an exteriorly operated umbrella canopy, of the covering including a portion that is reflective to minimize capture of heat from the sun.

Another feature of the present invention is the provision in an exteriorly operated umbrella canopy, of one of the first and second hubs including a male member and of the other of the first and second hubs including a female member that engages the male member to lock the first and second hubs to each other.

Another feature of the present invention is the provision in an exteriorly operated umbrella canopy, of one of the first and second hubs including an extension with an annular oblique face adjacent to an annular channel and of the other of the first and second hubs including a female member that engages said extension.

Another feature of the present invention is the provision in an exteriorly operated umbrella canopy, of one of the first and second hubs including a pair of opposed transversely sliding members that are normally biased toward each other and of the other of the first and second hubs including a male member that engages the opposed transversely sliding members.

Another feature of the present invention is the provision in an exteriorly operated umbrella canopy, of the button including a pair of first oblique faces, of the first hub including a pair of opposed transversely sliding members that are normally biased toward each other, where each of the opposed transversely sliding members includes a second oblique face, and of the second hub including a male member that engages the opposed transversely sliding members such that, when the button is depressed, the first oblique faces of the button engage, respectively, the second oblique faces of the opposed transversely extending members to urge the opposed transversely extending members apart to permit the long ribs to unflex and thereby draw the male member out of the first hub such that the flexible cover relaxes to the folded loose state.

Another feature of the present invention is the provision in an exteriorly operated umbrella canopy, of one of the first and second hubs including an extension with an annular oblique face adjacent to an annular channel, of one of the first and second hubs including a pair of opposed transversely sliding members that are normally biased toward each other such that, when the extension of one of the first and second hubs is pushed into the other of the first and second hubs, the annular oblique face of the extension urges apart the opposed transversely sliding members until the extension travels a given distance, whereupon the normal bias snaps the opposed transversely sliding members into the annular channel of the extension to engage the first and second hubs to each other.

Another feature of the present invention is the provision in an exteriorly operated umbrella canopy, of the line being a flexible line.

Another feature of the present invention is the provision in an exteriorly operated umbrella canopy, of each of the long ribs bending under less force than each of the short ribs.

Another feature of the present invention is the provision in an exteriorly operated umbrella canopy, of each of the short ribs having a greater diameter than each of the long ribs.

Another feature of the present invention is the provision in an exteriorly operated umbrella canopy, of a first hub, of a set of at least three long ribs radially extending from the first hub, where the long ribs include a flexed state when umbrella canopy is in the open flexed shape and a relaxed state when the umbrella canopy is in the closed relaxed shape, and of a flexible cover engaged to the long ribs and extending generally from the first hub to generally the distal ends of the long ribs, where the flexible cover includes generally a concave taut state when the umbrella canopy is in the open flexed shape and a folded loose state when the umbrella canopy is in the closed relaxed shape, where the flexible cover includes a peripheral edge, and where the peripheral edge defines a plane when the flexible cover is in the concave taut state.

Another feature of the present invention is the provision in an exteriorly operated umbrella canopy, of a first hub including an outer portion on the exterior or crown of the umbrella canopy and an inner portion on the interior of the umbrella canopy, of a second hub in the interior of the umbrella canopy, where the second hub is drawable to and away from the first hub, where the second hub is engageable to and disengageable from the first hub, where the umbrella canopy includes the open flexed shape when the first and second hubs are engaged to each other, and where the umbrella canopy includes the closed relaxed shape when the first and second hubs are disengaged from each other, and of a release on the outer portion of the first hub to disengage the first and second hubs from each other to permit the umbrella canopy to collapse from the open flexed shape to the closed relaxed shape.

Another feature of the present invention is the provision in an exteriorly operated umbrella canopy, of the second hub including a face opposite of where the second hub engages the first hub, where the face is an under face when the umbrella is in an upright position, and where the under face is stickless.

Another feature of the present invention is the provision in an exteriorly operated umbrella canopy, of the release being a depressible button.

An advantage of the present invention is a safe umbrella canopy. One feature contributing to this advantage is that the open and close mechanism is controlled from outside of the umbrella canopy. When the canopy is disposed over a playyard having a child therein, there is no umbrella handle or stick depending into the playyard that a child could 1) grab and thereby tilt the umbrella canopy or 2) grab and thereby operate the open and close mechanism on the umbrella handle or stick. In other words, the umbrella canopy is neither openable nor closeable from the inside of the umbrella.

Another advantage of the present invention is a bug free seal between the umbrella canopy and the surface with which the umbrella canopy interacts. One feature contributing to this advantage is the pair of inner and outer peripheral portions of the umbrella canopy. The inner peripheral portion is a peripheral edge that is taut and defines a plane. The outer peripheral portion is a set of flaps that, for example, depend downwardly from the taut peripheral edge and cover an upper edge of the playyard wall. The inner and outer peripheral portions work in combination to keep bugs and birds out of the playyard covered by the umbrella canopy.

Another advantage of the present invention is that it is simple and easy to operate. A feature contributing to this advantage is the flexible line that is drawn outwardly of the crown so as to open the umbrella canopy. Another feature contributing to this advantage is the button on the crown that permits the umbrella canopy to close.

Another advantage of the present invention is that the umbrella canopy may include unconventional and unique features not found in conventional umbrellas. For example, a zipper may be included to permit access to the inside of the canopy through a zippered opening without going under the peripheral edge of the umbrella canopy. In other words, the umbrella canopy need not be lifted to gain access to the inside of the umbrella canopy. Another example is that netting may be included so as to provide a means for air circulation into the umbrella canopy without permitting bugs to access the interior of the umbrella canopy. Another example is that elastic connectors may be engaged to the peripheral edge of the umbrella canopy to engage the umbrella canopy to the top of the endless wall of the playyard.

Another advantage is that the present invention is easy and inexpensive to manufacture. One feature contributing to this advantage is that the umbrella canopy is stickless. In other words, the umbrella canopy has no full length stick depending from the crown of the umbrella and no handle on the distal end of the stick, thereby saving on cost of materials.

DESCRIPTION

Figure 1A:
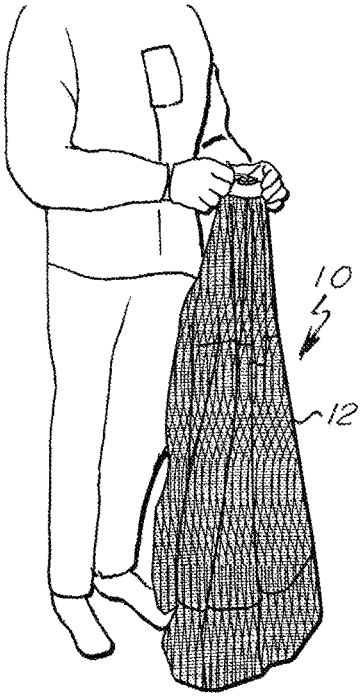
FIG. 1A is a perspective view of the present umbrella canopy in the closed relaxed shape where the flexible cover of the umbrella canopy is in a folded loose state.

The present umbrella canopy 10 generally includes a flexible cover 12, a first hub 14, a second hub 16, a set of resilient long ribs 18, a set of relatively rigid short ribs 20, and a flexible line 22 engaged to the second hub 16 and extending through the first hub 14.

Figure 1B:
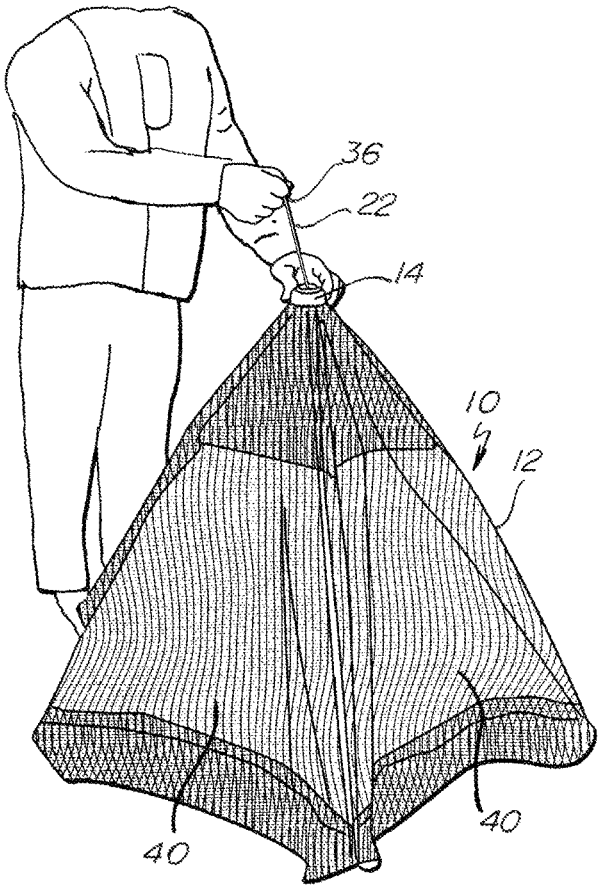
FIG. 1B is a perspective view of the umbrella canopy of FIG. 1A in an intermediate or transition state from the closed relaxed shape to an open flexed shape.
Figure 1C:
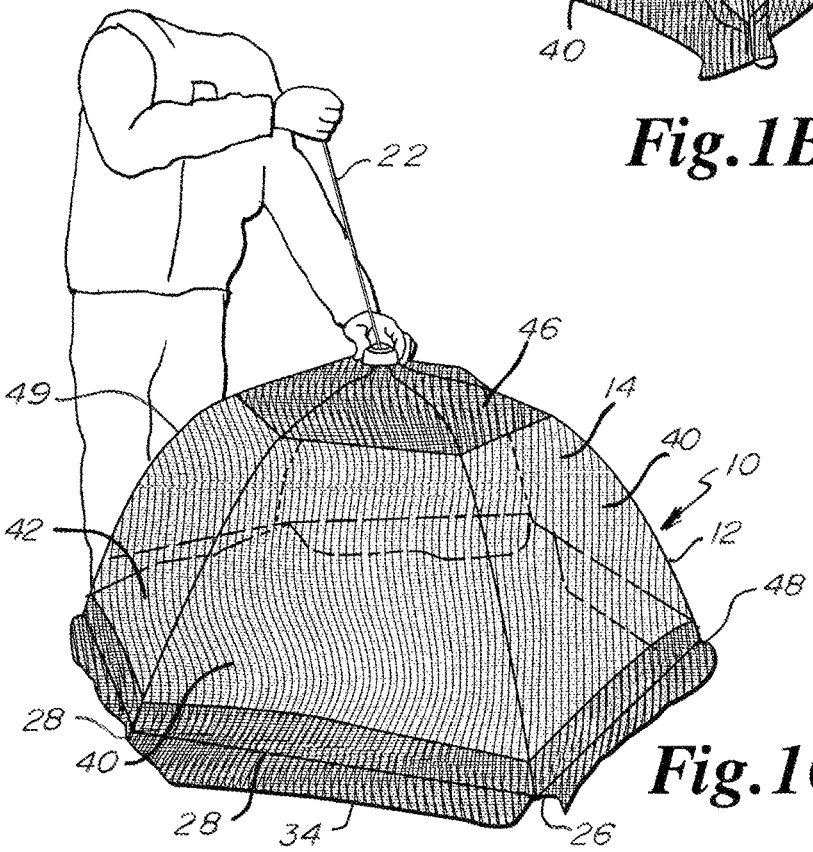
FIG. 1C is a perspective view of the umbrella canopy of FIG. 1A in an operating open flexed shape with the flexible cover in a concave taut state.

As shown in FIGS. 1A, 1B and 1C, the present umbrella canopy is indicated by reference number 10.

In FIG. 1A, the umbrella canopy 10 is in a closed relaxed shape where the flexible cover 12 is in a folded loose state. The resilient long ribs 18 are unflexed. The short ribs 20 are straight and at rest. The flexible line 22 is at rest and is slack. The first and second hubs 14, 16 are disengaged from each other and spaced apart from each other. Each of the long ribs 18 includes respective proximal and distal ends 24, 26 and the distal ends 26 confront each other and are spaced apart from each other. The proximal ends 24 are pivotally engaged to the first hub 14 and the distal ends 26 terminate generally at a first inner periphery edge 28 of the flexible cover 12. Inner periphery edge 28 runs from one distal end 26 of a first long rib 18 to an adjacent distal end 26 of an adjacent second long rib 18. Each of the short ribs 20 includes respective proximal and distal ends 30, 32. Each of the proximal ends 30 is pivotally engaged to the second hub 16 and each of the distal ends 32 is pivotally engaged to an intermediate section of one long rib 18. The distal ends 32 of the short ribs 20 confront each other, as the long ribs 18 are disposed almost in a parallel state, and are spaced apart from each other. The flexible cover 12 includes a set of flaps 34 depending from the inner peripheral edge 28. In folded loose state of FIG. 1A, the flaps 34 are folded and loose. Flexible line 22 includes a proximal end 36 and a distal end 38. The distal end 38 is engaged to the second hub 16.

In FIG. 1B, the proximal end 36 of the flexible line 22 is being pulled to draw the second hub 16 toward the first hub 14. As the second hub 16 is pulled toward the first hub 14, the short ribs 20 push against the intermediate sections of the long ribs 18. As the short ribs 20 push against the intermediate sections of the long ribs 18, the long ribs 18 begin to pivot upwardly on their proximal ends 24 at the first hub 14. As the long ribs 18 begin to pivot, the long ribs 18 fold out the flexible cover 12. Depending upon the weight of the flexible cover 12 and depending upon how far the flexible cover 12 has folded out, the long ribs 18 may or may not begin to bend and flex away from their straight state.

In FIG. 1C, the flexible line 22 has been fully pulled to pull the second hub 16 up to the first hub 14 and to lock the first and second hubs 14, 16 to each other. The flexible line 22 may be released, whereupon the first and second hubs 14, 16 remain locked to each other. As the second hub 16 approaches the first hub 14, the flexible cover 12 begins to stretch and, in response, the long ribs 18 begin to bend and flex and be placed under pressure. As the long ribs 18 begin to bend and flex, the second hub 16 continues to be drawn up and the distal ends of the short ribs 20 push even more against the intermediate sections of the long ribs 18, which places more pressure upon the long ribs 18, with an increased amount of bending and flexing of the long ribs 18 and with an increased amount of stretching of the flexible cover 12. When the second hub 16 has been fully drawn up so as to lock with the first hub 14, the flexible cover 12 is taut and the inner peripheral edge 28 is taut and defines a plane such that the umbrella canopy 10 is in an open flexed shape. In the open flexed shape of FIG. 1C, each of a set of triangular cover sections 40 of the flexible cover 12 are taut. A triangular cover section 40 is defined as the portion of the flexible cover 12 disposed between two adjacent long ribs 18 and further bounded by the inner peripheral edge 28. Each of the flaps 34 is engaged to the inner peripheral edge 28 and is loose and relaxed in the open flexed shape of the umbrella canopy 10 of FIG. 1C even though the adjacent triangular cover section 40 is taut. Further in the open flexed shape of the umbrella canopy 10 of FIG. 1C, the distal ends of the long ribs 18 are spaced apart from each other and the distal ends of the short ribs 20 are spaced apart from each other. While the long ribs 18 are flexed, the short ribs 20 maintain a relatively straight state. Each of the long ribs 18 takes a bowed or curved or concave form or state.

Figure 2A:
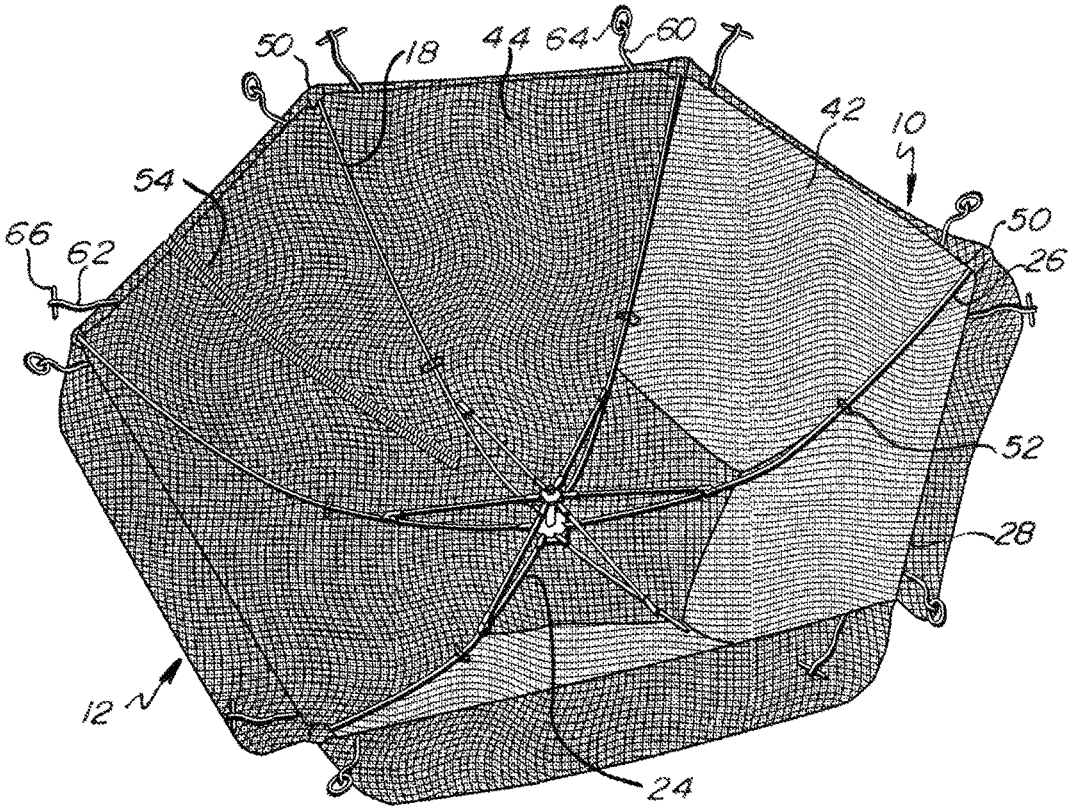
FIG. 2A is a perspective view of the interior of the umbrella canopy of FIG. 1C where the umbrella canopy is in the operating open flexed shape and where the crown of the umbrella canopy is resting on the ground and the interior of the umbrella canopy is turned upright, shows the first and second hubs engaged, shows the long ribs flexed, and shows the short ribs holding the long ribs in the flexed state.
Figure 2B:
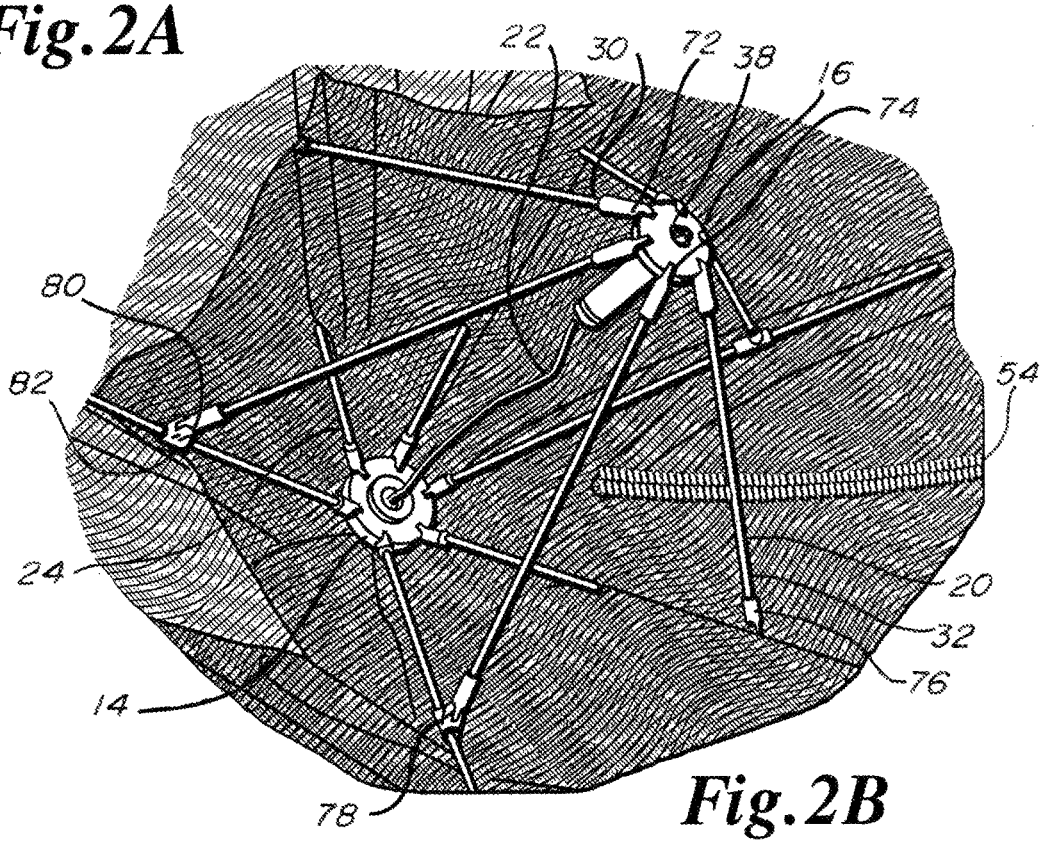
FIG. 2B is a detail partial view of the interior of the umbrella canopy of FIG. 1B where the umbrella canopy is in a transition state, shows the first and second hubs disengaged from each other, and further shows the long ribs unflexing and pushing upon the short ribs that in turn push the second hub away from the first hub.
Figure 3A:
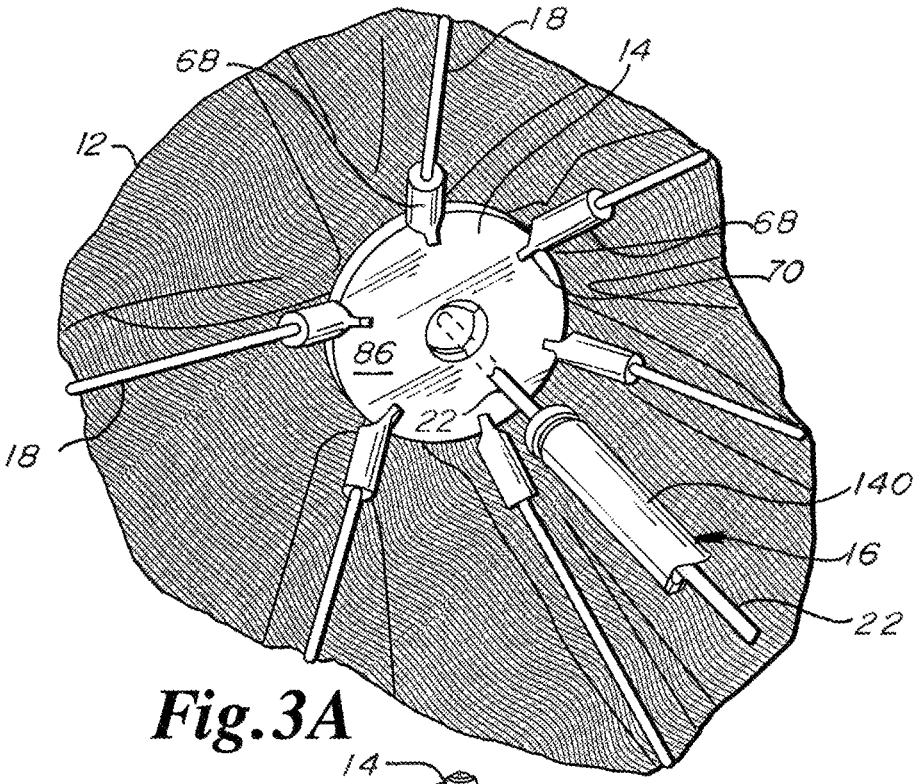
FIG. 3A is a detail partial view of the underside of the first hub and a portion of the second hub of the umbrella canopy of FIG. 1B where the umbrella canopy is in a transition state, shows the first and second hubs disengaged, shows the long ribs radiating away from the first hub, and shows the flexible line partially in phantom.
Figure 3B:
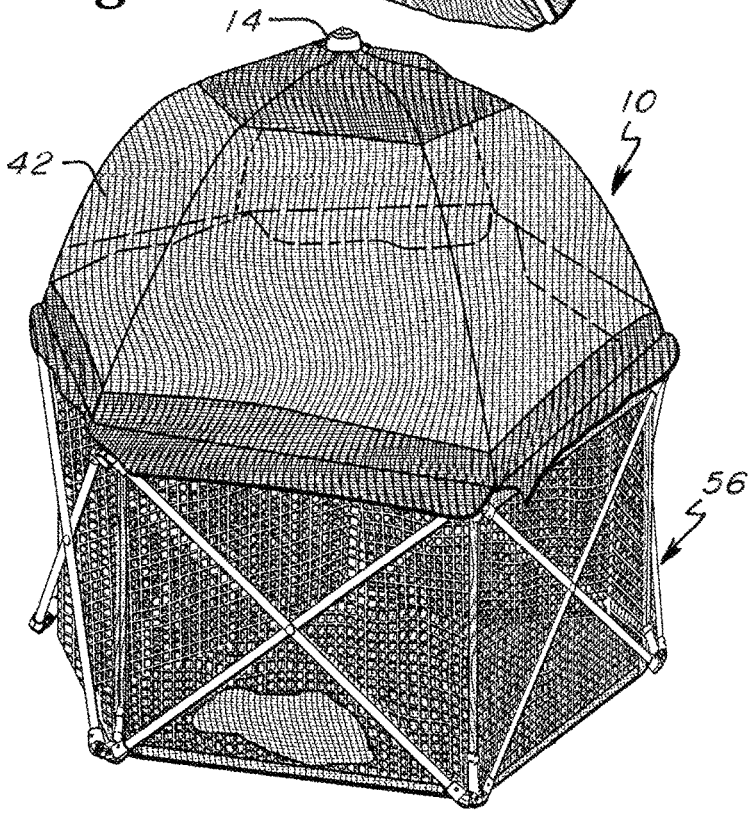
FIG. 3B is a front perspective view of the umbrella canopy of FIG. 1C on a playyard, where a front of the umbrella canopy includes netting.
Figure 4A:
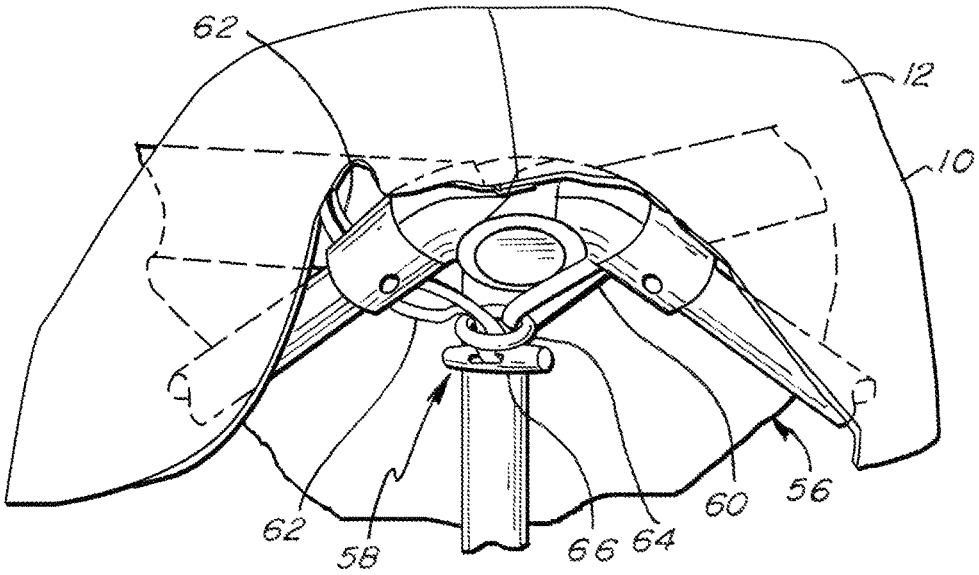
FIG. 4A is a detail perspective view of a quick connect elastic connector depending from the umbrella canopy for engaging the playyard of FIG. 3B.
Figure 4B:
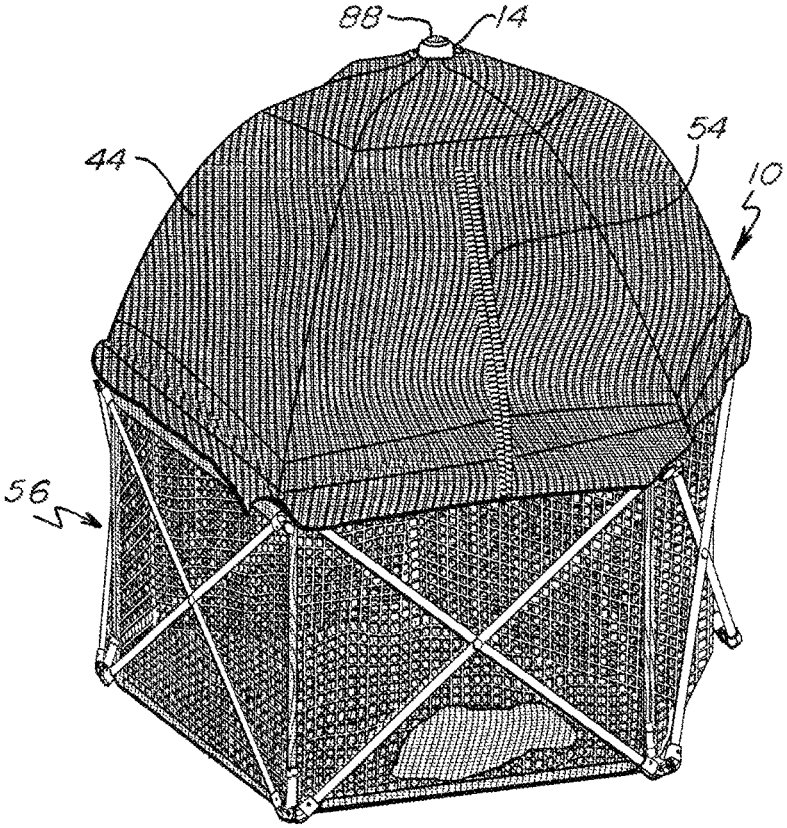
FIG. 4B is a rear perspective view of the umbrella canopy and playyard of FIG. 3B, where a rear of the umbrella canopy includes double layered sheeting.

Cover 12 is flexible. Cover 12 includes a set of three triangular cover sections 40 that include netting 42, shown in FIG. 3B, such as mosquito netting that keeps out mosquitos and other insects but permits in air and light. Cover 12 includes a set of three triangular cover sections 40 that include a double layer of sheeting 44, as shown in FIG. 4B. The outer layer is a water resistant layer and may be a silver color or a reflective color or nature to minimize capture of heat from the sun. The inner layer is an ultraviolet (UV) protective layer. One triangular cover section 40 may not consist entirely of netting 42 or entirely of sheeting 44. As shown in FIG. 1C, for example, a triangular crown cover portion 46 of sheeting 44 may be disposed near the crown of the umbrella canopy 10 and, in the same triangular cover section 40, a strip 48 of sheeting 44 may be disposed directly above the inner peripheral edge 28 and, in the same triangular cover section 40, a generally quadrilateral section of netting 42 may be disposed between the triangular crown cover portion 46 and the sheeting strip 48. As shown in FIG. 2A, a triangular cover section 40 may be disposed entirely of the double layer sheeting 44. Flaps 34 are made up of the double layer sheeting 44.

At the crown of the umbrella canopy 10, flexible cover 12 is pinched between two portions of the first hub 14, where such two portions may be formed generally in the shape of a disk. At the crown of the umbrella canopy 10, prior to being pinched between the two disk like portions of the first hub 14, a circular opening may be formed in the crown or central portion of the flexible cover 12. The endless edge forming this circular opening may be reinforced.

From the crown of the flexible cover 12, the flexible cover 12 radiates outwardly. Six triangular cover sections 40 diverge outwardly of the crown of the flexible cover 12. Each of the triangular cover sections 40 includes a generally pointed or blunt proximal end at the crown, and a distal end at the inner peripheral edge 28. The sides of the triangular cover sections 40 are stitched together, so as to form a seam 49, such that one side of a triangular cover section 40 is stitched to a side of an adjacent triangular cover section 40.

The flexible cover 12 includes a pocket 50 at the junction between the seam 49 and the inner peripheral edge 28 such that the pocket 50 is disposed at the distal end of the seam 49. The distal end of the long rib 18 is engaged in the pocket 50.

At the seam 49 between two adjacent triangular cover sections 40, flexible cover 12 includes on the inside of the flexible cover 12 a flexible loop 52 of a cord or strap that one long rib 18 passes through. The flexible loop 52 of cord is adjacent to and spaced from the junction between the short rib 20 and the long rib 18. The flexible loop 52 of cord is between the distal end of the long rib 18 and the junction between the short rib 20 and the long rib 18.

Flexible cover 12 includes a zipper 54. Zipper 54 is found in a triangular cover section 40 that includes only the double layer sheeting 44. If desired, the zipper 54 may be found in netting 42 and in a triangular cover section 40 that includes netting 42 and the double layer sheeting 44. As shown in FIG. 4B, the upper or proximal end of the zipper 54 is spaced from the crown of the umbrella canopy 10 and is disposed about one-fifth of the distance from the crown of the umbrella canopy 10 to the distal edge of flap 34. The distal edge of the zipper 54 is disposed on the distal end of the flap 34 of the triangular cover section 40 having the proximal end of the zipper 54. The zipper 54 may be opened up from the distal end or down from the proximal end or both. When the zipper 54 is open fully or partially, a caregiver may place a child into the playyard 56 or lift a child out of the playyard 56.

The flexible cover 12 includes a quick connect mechanism 58 disposed generally at the distal end of each of the seams 49. The quick connect mechanism 58 can engage any part of the playyard 56 that is available, preferably a part of the frame of the playyard 56. The quick connect mechanism 58 includes a first elastic strap loop 60 and a second elastic strap loop 62. A ring 64 is slideably engaged on loop 60. A slotted peg 66 is slideably engaged on loop 62. The length of the peg 66 is greater than the diameter of the ring 66. Each of the loops 60, 62 is anchored on the inner peripheral edge 28. Loop 60 is anchored on one side of the distal end of the long rib 18. Loop 62 is anchored on the other side of the distal end of the same long rib 18. There is one quick connect mechanism 58 adjacent to the distal end of each of the long ribs 18.

The quick connect mechanism 58 holds the umbrella canopy 10 to and on top of the endless wall of the playyard 56 at six attachment points. Playyard 56 is a hexagonal shape, having six straight wall sections. The inner peripheral edge 28 of the umbrella canopy 10 is a hexagonal shape, where each of the distal ends of each of the triangular cover sections 40 defines one side of a hexagon.

Flaps 34 extend downwardly below a top edge of the endless wall of the playyard 56 so as to maximize a sealing of the junction between the inner peripheral edge 28 of the umbrella canopy 10 and the top edge of the endless wall of the playyard 56. Flaps 34 close off spaces and openings between the top edge of the endless wall of the playyard 56 and the inner peripheral edge 28 of the flexible cover 12.

Long rib 18 is an elongate resilient plastic shaft. The proximal end 24 of the long rib 18 includes a cap 68 in which the shaft is set. A body of the cap 68 is elongate and cylindrical. The length of the body of the cap 68 minimizes fractures in the proximal end 24 of the long rib 18. An integral plate or disk extension 70 of the cap 68 is pivotally engaged to the first hub 14. Each of the long ribs 18 radiate from a periphery of the first hub 14. Each of the long ribs 18 includes a first intermediate section where the short rib 20 is connected to the long rib 18. Each of the long ribs 18 includes a second intermediate section where the long rib 18 passes through the loop 52. The second intermediate section is between the first intermediate section and the distal end 26 of the long rib 18. Each of the long ribs 18 includes the distal end 26, where the distal end 26 is captured in the pocket 50 of the flexible cover 12. The long rib 18 may take a straight form, such as in FIG. 1A, a partially bowed or partially flexed form such as in FIG. 1B, and a bowed or flexed form such as in FIG. 1C. In the bowed or flexed form of FIG. 1C, under pressure from the short ribs 20, the long ribs 18 push outwardly upon an inside face of the flexible cover 12. Short rib 20 is shorter in length than long rib 18.

Short rib 20 has a greater diameter than long rib 18 such that short rib 20 is thicker than long rib 18. In FIG. 1A, where the umbrella canopy 10 is in a closed relaxed shape, the short rib 20 takes a straight form and is under no tension. In FIG. 1B, where the umbrella canopy 10 is in a transition state and the flexible cover 12 is beginning to unfold, the short rib 20 is in a straight form and under slight tension. In FIG. 1C, where the umbrella canopy 10 is in an open flexed shape, the short rib 20 is generally straight and is under tension. At its proximal end 30, short rib 20 includes a cap 72 with an elongate cylindrical body. The length of the body of the cap 72 minimizes fractures in the proximal end 30 of the short rib 20. Cap 72 further includes an integral plate or disk extension 74 that is pivotally engaged to a periphery of the second hub 16. At its distal end 32, short rib 20 includes a cap 76 with an elongate cylindrical body. The length of the body of the cap 76 minimizes fractures in the distal end 32 of the short rib 20. Cap 76 further includes an integral plate or disk extension 78 that is pivotally engaged to and between ears 80 of a tube 82. Tube 82 is rigidly affixed to the first intermediate section of long rib 18. Tube 82 is elongate and applies pressure from the short rib 20 over a length of the long rib 18 instead of merely a point of the long rib 18 so as to minimize fracturing the long rib 18 at the point of connection.

Figure 5:
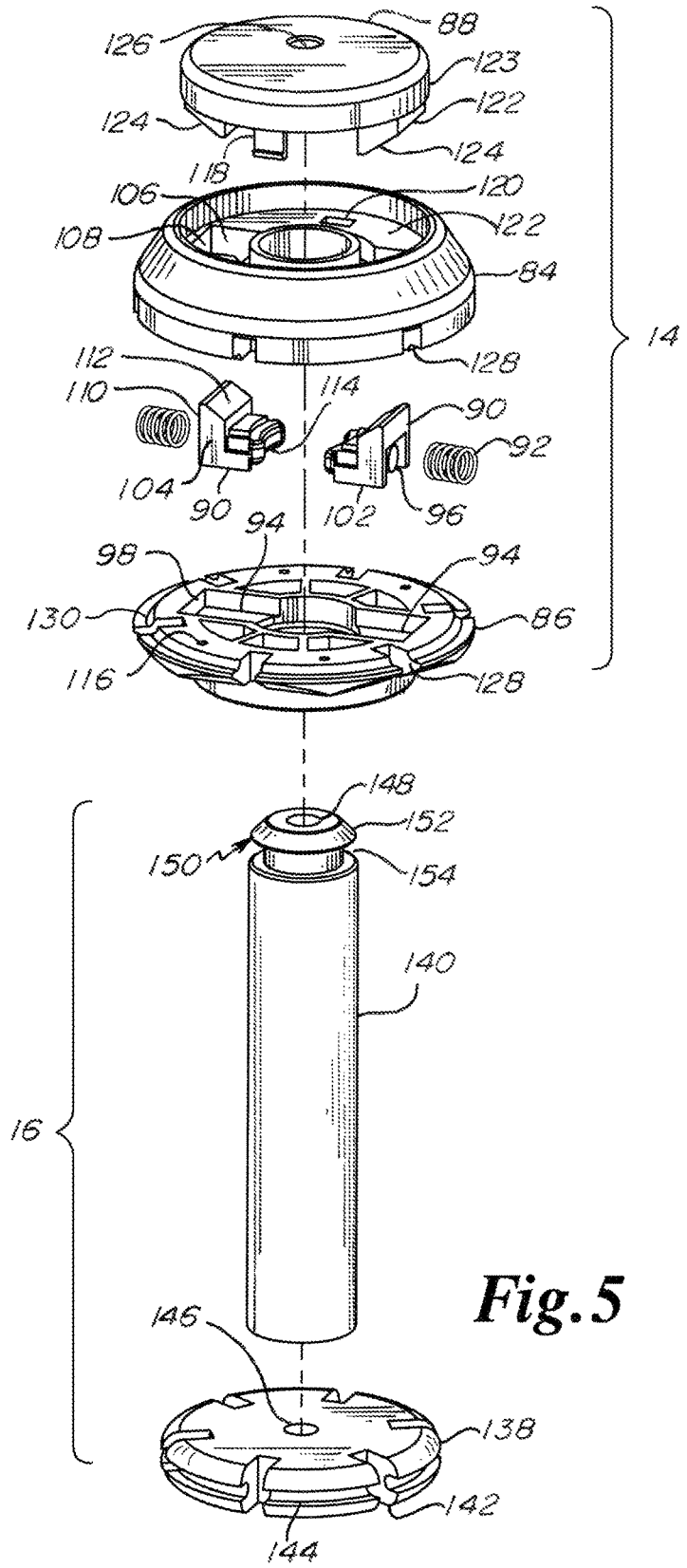
FIG. 5 is an exploded perspective detail view of the first and second hubs of the umbrella canopy of FIG. 1A.
Figure 6A:
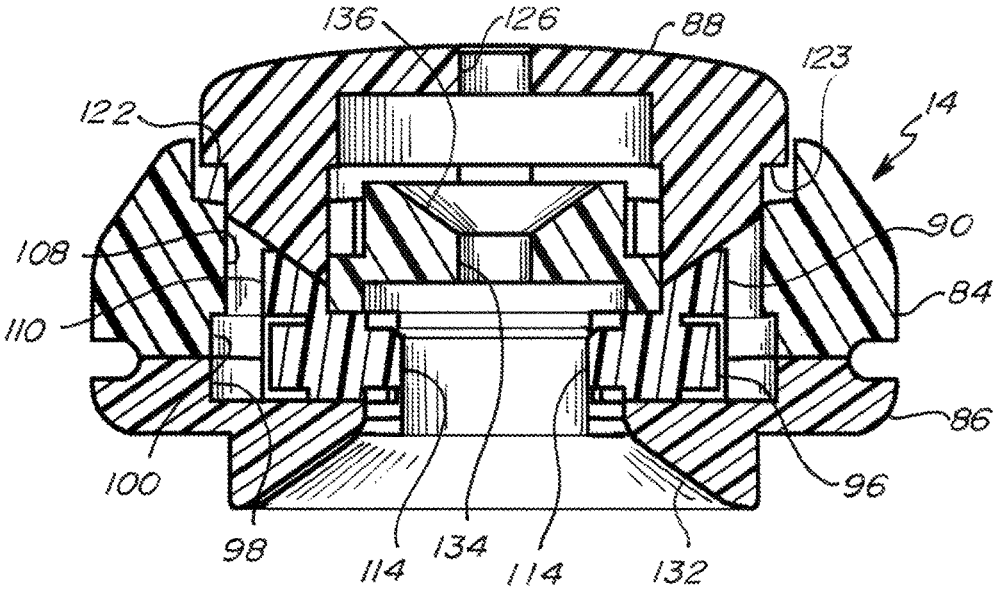
FIG. 6A is a section diagrammatic assembled view of the first hub of FIG. 5 free of the second hub of FIG. 5.
Figure 6B:
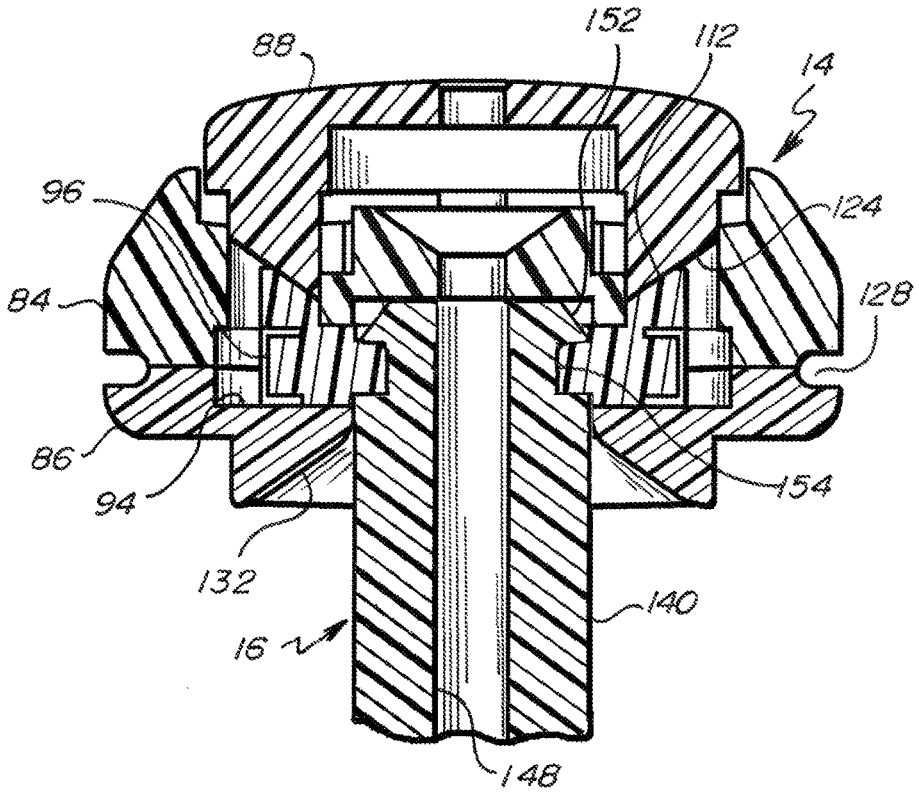
FIG. 6B is a section diagrammatic assembled view of the first hub of FIG. 5 engaging a portion of the second hub of FIG. 5.

The first and second hubs 14, 16 are shown in greater detail in FIGS. 5, 6A and 6B. First hub 14 includes respective upper and lower housing portions 84, 86 to form a housing. A button or release 88 is engaged in upper housing portion 84. Locking opposed transversely sliding members 90 are engaged between and in the upper and lower housing portions 84, 86 and are normally biased toward each other by coil springs 92. Sliding members 90 slide in their own respective channels 94. Channels 94 oppose each other diametrically. Coil springs 92 engage pegs 96 on the rear of the sliding members 90. Coil spring 92 is on peg 96 and sandwiched between sliding member 90 and end inner wall 98 of second housing portion 86 and an aligned end inner wall 100 of the first housing portion 84. End walls 98, 100 form a receptor for the outer end of the coil spring 92. Sliding member 90 further includes a bottom 102 that includes flat sections for sliding on the bottom of the channel 94 and a flat sidewall 104 in the shape of an L for sliding against the sidewalls of the channel 94, which channel 94 is defined in part by end walls 98, 100 and sidewall 106. Sidewall 106 is on the upper housing portion 84. Sidewall 106 runs at a right angle to end wall 108, which extends inwardly of end wall 100. End wall 108 serves as a stop for a rear surface 110 of sliding member 90. Sliding member 90 further includes oblique face 112 that is oblique relative to the axis of the flexible line 22 and the axis of the first and second hubs 14, 16. Oblique face 112 extends between sidewalls 104 and is disposed inwardly of rear surface or rear wall 110 of the sliding member 90. Each of the sliding members 90 includes a curved catch 114 opposite of peg 96. Curved catches 114 of the respective sliding members 90 confront each other.

Lower housing member 86 includes a set of pin holes 116 employed to receive pins that engage upper housing member 84 to tie upper and lower housing members 84, 86 together and to sandwich sliding members 90 and the coil springs 92 therebetween. The flexible cover 12 includes an opening at the crown for the first hub 14. An endless circular edge forming this opening is pinched between the upper and lower housing members 84, 86 such that upper housing member 84 is an exterior housing member and lower housing member 86 is an interior housing member relative to the flexible cover 12.

The button 88 includes a pair of diametrically opposed downwardly extending barbs 118 that engage a pair of diametrically opposed slots 120 formed in a floor 122 of the upper housing 84. Barbs 118 permit the button 88 to be depressed and prevent the button 88 from being urged out of the upper housing 84. Floor 122 acts as a stop for an annular peripheral lip 123 of button 88. Buttons 88 further include pushers or extensions 122. Each of the pushers 122 includes an oblique surface 124. Surface 124 is oblique relative to the axis of flexible line 22 and relative to the axis of the first and second hubs 14, 16. Pusher 122 pushes sliding member 90 outwardly when the button 88 is depressed to release the second hub 16 from the first hub 14, with the flexed long ribs 18 drawing the second hub 16 out of the first hub 14 when the catches 114 release the second hub 16. Button 88 further includes a central through opening 126 for the flexible line 22.

Each of the upper and lower housing portions 84, 86 form a partial portion of the long rib receptor 128. The partial portion of the receptor 128 formed by the upper housing portion 84 is closed or has an upper boundary. The partial portion formed by the lower housing portion 86 is open to permit the disk like or plate projection 70 of the cap 68 of the long rib 18 a great amount of swing, such as between the closed relaxed shape of FIG. 1A and the open flexed shape of FIG. 1C. The disk like or plate projections 70 are engaged to the first hub 14 by an annular metal ring set in an annular depression 130 formed in the lower housing portion 86. The annular metal ring is held in place by being pinched between the upper and lower housing portions 84, 86. The disk like or plate projection 70 has a through opening to receive the annular metal ring and to pivot thereabout to permit the long rib 18 to pivot.

Lower housing portion 86 includes an annular oblique guide surface 132 for guiding the second hub 16 into the first hub 14. Annular oblique guide surface 132 is coaxial with first and second hubs 14, 16.

Upper housing portion 84 is formed of a body of plastic and such body of plastic forms an axial through opening 134 for guiding the flexible line 22. Opening 134 leads upwardly to an annular oblique guide surface 136. When flexible line 22 is drawn into the umbrella canopy 10 by the button 88 being depressed and the flexible line 22 being drawn out relatively quickly by the unflexing of the long ribs 18, annular oblique guide surface 136 minimizes any resistance on the part of the upper housing portion 84 to the flexible line 22 passing therethrough.

Second hub 16 includes a disk like portion 138 and a tubular shaft or male member 140. Disk like portion 138 and tubular shaft 140 are integral and one-piece. Disk like portion 138 includes a set of radially disposed short rib receptor slots 142 for the plate like or disk like portions 74 of the caps 72 of the proximal ends 30 of the short ribs 20. The plate like or disk like portions 74 have pivot openings centrally formed therein for receiving an annular metal ring set in a peripheral channel 144 of the disk like portion 138 such that short ribs 20 are pivotable relative to the second hub 16. Disk like portion 138 includes an axial opening 146 for the flexible line 22. Disk like portion 138 is at a proximal end of the second hub 16. Disk 138 or disk like portion 138 is free of a handle or stick depending therefrom.

Shaft portion 140 extends axially and integrally from the upper surface of disk like portion 138. Shaft portion 140 is tubular so as to form an axial through opening 148 through which flexible line 22 extends. Shaft portion 140 includes a head 150 at a distal end of the second hub 16. Head 150 includes an annular oblique surface 152 for pushing away or pushing outwardly the sliding members 90. Shaft portion 140 further includes an annular channel 154 disposed immediately adjacent to the head 150 and annular oblique surface 152. Annular channel 154 receives the curved catches 114 of the sliding members 90 such that the head 150, shaft 140 and second hub 16 as a whole is locked between the sliding members 90 and to the first hub 14.

Flexible line 22 is one-piece. Flexible line 22 may be a cord or chain or wire. If desired, flexible line 22 may be replaced by a rigid straight rod. Flexible line 22 is fixed, such as by pins to the underside of the disk like portion 138 of the second hub 16. Flexible line 22 extends upwardly through opening 146 of the disk like portion 138, further upwardly through opening 148 of shaft 140, further upwardly through annular guide surface 132 when the first and second hubs 14, 16 are not engaged, further upwardly through opening 134 in the center of upper housing portion 84, through annular guide surface 136, and through opening 126 of button 88. The distal end of flexible line 22 is engaged to the undersurface of disk like portion 138. The proximal end of flexible line 22 may be disposed adjacent to the upper surface of button 88 when the umbrella canopy 10 is in the closed relaxed shape of FIG. 1A. The proximal end of flexible line 22 may be spaced apart from the upper surface of button 88 when the umbrella canopy 10 is in the open flexed shape of FIG. 1C. To prevent the flexible line 22 from being withdrawn into the first hub 14 to an inaccessible location, the flexible line 22 may have a knot having a greater width or greater diameter than the button opening 126. If desired, a sphere or ball like knob may be fixed on or near the proximal end of line 22, where the sphere or ball like knob has a greater width or greater diameter than the button opening 126.

In operation, to close the umbrella canopy 10 from the open flexed shape of FIG. 1C to the closed relaxed shape of FIG. 1A, the button 88 is depressed. As the button 88 is depressed, the oblique surfaces 124 of the pushers 122 that are integral with button 88 push against oblique surfaces 112 of the sliding members 90, whereupon the catches 114 slide out of the annular channel 154 of the shaft portion 140 of the second hub 16, whereupon the release of tension provided by the unflexing long ribs 18 pushes the short ribs 20 downwardly, which draws the head 150 of the second hub 16 out of the first hub 14, whereupon the long ribs 18 and flexible cover 12 fall under the influence of gravity to the closed relaxed shape of FIG. 1A.

To open the umbrella canopy 10, the proximal end of the flexible line 22 is pulled, whereupon the second hub 16 is drawn upwardly, whereupon the short ribs 20 push upwardly upon the first intermediate section of the long ribs 18, which push up the flexible cover 12. As the second hub 16 is drawn upwardly, the annular oblique surface 152 is drawn up against the undersides of the curved catches 114, thereby pushing apart the sliding members 90 until the shaft portion 140 is drawn still further upwardly, whereupon the curved catches 114 snap into the annular channel 154 under pressure from the expanding coil springs 92. At such a point the flexible cover 12 is taut, with the exception of the relaxed flaps 34, and in the open flexed shape.

It should be noted that the present umbrella canopy 10 includes six triangular cover sections 40. However, the umbrella canopy of the present invention may be formed from three to eight or more triangular cover sections 40.

It should be noted that the inside surface of flap 34 and/or an inside section along peripheral edge 28 may include macroscopic hook portions or macroscopic loop portions, such as Velcro® portions, that may engage fabric portions of the playyard 56 or of a carpet.

As indicated, the double layered breathable sheeting 44 has a water resistant outer layer and an inner layer that is UV protective. The water resistant outer layer preferably includes a hydrostatic head measurement of at least about 1000 mm (a rating that resists light showers). "Hydrostatic Head" (HH) is a way of measuring how water resistant a piece of fabric is. Preferably the water resistant outer layer has a hydrostatic head rating of between about 1000 mm and about 2000 mm. If desired, flexible cover 12 may be impervious to water and moisture. If desired, flexible cover 12 may be formed of a waterproof/breathable fabric that resists liquid water passing through, but allows water vapor to pass through such that the flexible cover 12 has the capability to block out rain and snow while allowing vapor such as sweat to evaporate.

The second or inner or under layer of the double layered sheeting 44 is a UV (ultraviolet) protective or sun protective layer that may include one or more of the following features: 1) a preferred weave structure and denier (related to thread count per inch), 2) a pre-treatment with UV-inhibiting ingredients during manufacture, 3) a preferred inherent fiber structure, 4) a preferred density of weave, 5) preferred dye components, such as darker colors and indigo dyes, 6) preferred high percentages or blends of heavy-weight natural fibers such as cotton, linen and hemp, 7) relatively high percentages of lightweight synthetics such as polyester, nylon, spandex and polypropylene, and 8) natural or synthetic indigo-dyed denim, twill weaves and canvas. The inner layer of the double layered sheeting 44 can be selected according to 1) the weave of the fabric, 2) the less open or more dense the fabric, 3) color, 4) weight, and 5) stretch. The inner layer of the sheeting 44 may include a polyester or other fabric that contains a UV absorber such as a benzene ring that absorbs UV light. The inner layer of the sheeting 44 may include UV absorbers such as nanoparticles of titanium dioxide embedded into a nylon fabric. The inner layer of the double layered sheeting 44 may include 1) cotton viscose fabrics, 2) black or dark blue denim, 3) wool, 4) satin-finished silk of any weight, 5) tightly woven Bamboo/Lycra fabric, 6) polyacrylonitrile, 7) 100% polyester, 8) shiny polyester blends, 9) tightly woven fabrics, 10) unbleached cotton, and/or 11) a bamboo/cotton blend. The inner layer of the double layered sheeting 44 preferably includes an Ultraviolet Protection Factor (UPF) of between about 15 and about 24 (where about 93.3 to about 95.9 percent of UV radiation is blocked), more preferably includes an Ultraviolet Protection Factor of about 25 to about 39 (where about 96.0 to about 97.4 percent of UV radiation is blocked), and still more preferably includes an Ultraviolet Protection Factor of about 40 to about 50 (where about 97.5 to about 98 percent of UV radiation is blocked). The Ultraviolet Protection Factor may be measured by one or more of the American Association of Textile Chemists and Colorists (AATCC) Test Method 183, which may be used in conjunction with ASTM D 6544 and ASTM D 6603.

As to playyard 56, the following are hereby incorporated by reference in their entireties into this application, 1) U.S. patent application Ser. No. 15/080,502 filed Mar. 24, 2016 and entitled Playyard, and 2) U.S. Pat. No. 9,144,325 issued Sep. 29, 2015 and entitled Foldable Playyard.

The umbrella canopy 10 includes a set of flaps 34. Each of the flaps 34 is engaged to the inner peripheral edge 28 continually to and between two distal ends 26 of two respective adjacent long ribs 18. Each of the flaps 34 extends beyond the inner peripheral edge 28 to define an outer periphery. Each of the flaps 34 is in a relaxed and nontaut state both when the flexible cover 12 is in the concave taut state and when the flexible cover 12 is in the folded loose state. The set of flaps 34 extends completely about the flexible cover 12. Each of the flaps 34 includes first and second adjacent flaps 34. Each of the flaps 34 includes a right end and a left end. The right end of each of the flaps 34 is adjacent to a left end of the first adjacent flap 34. The left end of each of the flaps 34 is adjacent to a right end of the second adjacent flap 34. Each of the flaps 34 extends horizontally in a direction that is oblique to a horizontal direction of each of the first and second adjacent flaps 34.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. An umbrella canopy having an open flexed shape and a closed relaxed shape, the umbrella canopy having an exterior and interior, the umbrella canopy comprising:

a) a first hub having an outer portion on a crown of the umbrella canopy and an inner portion on the interior of the umbrella canopy;

b) a second hub in the interior of the umbrella canopy, the second hub drawable to and away from the first hub, the second hub engageable to and disengageable from the first hub;

c) a set of at least three long ribs radially extending from the first hub, each of the long ribs having a proximal end, a distal end and an intermediate section therebetween, each of said proximal ends of the long ribs pivotally engaged to said first hub, the long ribs having a flexed state when the umbrella canopy is in the open flexed shape and a relaxed state when the umbrella canopy is in the closed relaxed shape;

d) a set of at least three short ribs radially extending from the second hub, each of the short ribs having a proximal end and a distal end, each of the proximal ends of the short ribs pivotally engaged to the second hub, each of the distal ends of the short ribs pivotally engaged to the intermediate section of one of said long ribs;

e) a flexible cover engaged to the long ribs and extending generally from the first hub to generally said distal ends of the long ribs, the flexible cover having generally a concave taut state when the long ribs are in the flexed state and a folded loose state when the long ribs are in the relaxed state, the flexible cover having an inner peripheral edge;

f) a line having a proximal end and a distal end, the distal end of the line being engaged to the second hub, the line extending through the first hub, the proximal end of the line being disposed outside the interior of the umbrella canopy such that the proximal end of the line can be pulled to i) draw the second hub in the direction of the first hub such that the short ribs push against the main ribs and place the long ribs into the flexed state and ii) further draw the second hub in the direction of the first hub until the second hub engages the first hub to lock the long ribs in the flexed state and the flexible cover in the concave taut state;

g) a set of flaps, each of said flaps engaged to said inner peripheral edge continually to and between two distal ends of two respective adjacent long ribs;

h) each of said flaps extending beyond said inner peripheral edge to define an outer periphery;

i) each of the flaps being in a relaxed and nontaut state both when the flexible cover is in the concave taut state and when the flexible cover is in the folded loose state;

j) said set of flaps extending completely about the flexible cover;

k) each of the flaps having first and second adjacent flaps, each of the flaps having a right end and a left end, the right end of each of the flaps being adjacent to a left end of said first adjacent flap, the left end of each of the flaps being adjacent to a right end of said second adjacent flap;

l) each of the flaps extending horizontally; and m) wherein one of the first and second hubs includes an elongated extension with an annular oblique face adjacent to an annular channel and wherein the other of the first and second hubs includes a pair of opposed transversely sliding members that are normally biased toward each other; and wherein said elongated extension of the second hub is insertable into the first hub, such that the sliding members engage the annular channel to releasably lock the first hub and the second hub together.

2. The umbrella canopy of claim 1, wherein the first hub includes a button accessible from the exterior of the umbrella canopy, the button being depressible to disengage the second hub from the first hub, whereupon the long ribs unflex and push the short ribs and second hub away from the first hub and such that the flexible cover collapse from the concave taut shape to the folded loose state.

3. The umbrella canopy of claim 1, wherein the flexible cover includes a set of cover sections, each of the sections having first and second edges defined by adjacent long ribs, each of the sections having a distal edge running between the distal ends of said adjacent long ribs, the distal edges of the sections defining a plane when the flexible cover is in the concave taut shape.

4. The umbrella canopy of claim 1, wherein the inner peripheral edge defines a plane when the flexible cover is in the concave taut shape.

5. The umbrella canopy of claim 1, wherein the second hub includes a first portion and a second portion, the first portion being adjacent to the first hub when the first and second hubs are engaged, the second portion being opposite of the first portion, the second portion being coaxial with the line when the flexible cover is in the concave taut state, the second portion being an under face of the second hub, the under face being free of a stick.

6. The umbrella canopy of claim 1, wherein said elongated extension is includes an integral shaft that is coaxial with the first and second hubs, the line running through the integral shaft.

7. The umbrella canopy of claim 1, wherein the flexible cover includes netting.

8. The umbrella canopy of claim 1, wherein the flexible cover includes a portion that is water resistant.

9. The umbrella canopy of claim 1, wherein the flexible cover includes a portion that is reflective to minimize capture of heat from the sun.

10. The umbrella canopy of claim 1, wherein the line is a flexible line.

11. The umbrella canopy of claim 1, wherein each of said long ribs bends under less force than each of the short ribs.

12. The umbrella canopy of claim 1, wherein each of said short ribs has a greater diameter than each of the long ribs.

13. An umbrella canopy having an open flexed shape and a closed relaxed shape, the umbrella canopy having an exterior and interior, the umbrella canopy comprising:

a) a first hub having an outer portion on a crown of the umbrella canopy and an inner portion on the interior of the umbrella canopy;

b) a second hub in the interior of the umbrella canopy, the second hub drawable to and away from the first hub, the second hub engageable to and disengageable from the first hub;

c) a set of at least three long ribs radially extending from the first hub, each of the long ribs having a proximal end, a distal end and an intermediate section therebetween, each of said proximal ends of the long ribs pivotally engaged to said first hub, the long ribs having a flexed state when the umbrella canopy is in the open flexed shape and a relaxed state when the umbrella canopy is in the closed relaxed shape;

d) a set of at least three short ribs radially extending from the second hub, each of the short ribs having a proximal end and a distal end, each of the proximal ends of the short ribs pivotally engaged to the second hub, each of the distal ends of the short ribs pivotally engaged to the intermediate section of one of said long ribs;

e) a flexible cover engaged to the long ribs and extending generally from the first hub to generally said distal ends of the long ribs, the flexible cover having generally a concave taut state when the long ribs are in the flexed state and a folded loose state when the long ribs are in the relaxed state, the flexible cover having an inner peripheral edge;

f) a line having a proximal end and a distal end, the distal end of the line being engaged to the second hub, the line extending through the first hub, the proximal end of the line being disposed outside the interior of the umbrella canopy such that the proximal end of the line can be pulled to i) draw the second hub in the direction of the first hub such that the short ribs push against the main ribs and place the long ribs into the flexed state and ii) further draw the second hub in the direction of the first hub until the second hub engages the first hub to lock the long ribs in the flexed state and the flexible cover in the concave taut state;

g) a set of flaps, each of said flaps engaged to said inner peripheral edge continually to and between two distal ends of two respective adjacent long ribs;

h) each of said flaps extending beyond said inner peripheral edge to define an outer periphery;

i) each of the flaps being in a relaxed and nontaut state both when the flexible cover is in the concave taut state and when the flexible cover is in the folded loose state;

j) said set of flaps extending completely about the flexible cover;

k) each of the flaps having first and second adjacent flaps, each of the flaps having a right end and a left end, the right end of each of the flaps being adjacent to a left end of said first adjacent flap, the left end of each of the flaps being adjacent to a right end of said second adjacent flap;

l) each of the flaps extending horizontally; and m) wherein one of the first and second hubs includes a pair of opposed transversely sliding members that are normally biased toward each other and wherein the other of the first and second hubs includes a male member that engages the opposed transversely sliding members.

14. An umbrella canopy having an open flexed shape and a closed relaxed shape, the umbrella canopy having an exterior and interior, the umbrella canopy comprising:

a) a first hub having an outer portion on a crown of the umbrella canopy and an inner portion on the interior of the umbrella canopy;

b) a second hub in the interior of the umbrella canopy, the second hub drawable to and away from the first hub, the second hub engageable to and disengageable from the first hub;

c) a set of at least three long ribs radially extending from the first hub, each of the long ribs having a proximal end, a distal end and an intermediate section therebetween, each of said proximal ends of the long ribs pivotally engaged to said first hub, the long ribs having a flexed state when the umbrella canopy is in the open flexed shape and a relaxed state when the umbrella canopy is in the closed relaxed shape;

d) a set of at least three short ribs radially extending from the second hub, each of the short ribs having a proximal end and a distal end, each of the proximal ends of the short ribs pivotally engaged to the second hub, each of the distal ends of the short ribs pivotally engaged to the intermediate section of one of said long ribs;

e) a flexible cover engaged to the long ribs and extending generally from the first hub to generally said distal ends of the long ribs, the flexible cover having generally a concave taut state when the long ribs are in the flexed state and a folded loose state when the long ribs are in the relaxed state;

f) a line having a proximal end and a distal end, the distal end of the line being engaged to the second hub, the line extending through the first hub, the proximal end of the line being disposed outside the interior of the umbrella canopy such that the proximal end of the line can be pulled to i) draw the second hub in the direction of the first hub such that the short ribs push against the main ribs and place the long ribs into the flexed state and ii) further draw the second hub in the direction of the first hub until the second hub engages the first hub to lock the long ribs in the flexed state and the flexible cover in the concave taut state;

g) wherein said first hub includes a button that includes a pair of first oblique faces;

h) wherein the first hub includes a pair of opposed transversely sliding members that are normally biased toward each other, each of the opposed transversely sliding members having a second oblique face; and i) wherein the second hub includes a male member that engages the opposed transversely sliding members;

j) such that, when the button is depressed, the first oblique faces of the button engage, respectively, the second oblique faces of the opposed transversely extending members to urge the opposed transversely extending members apart to permit the long ribs to unflex and thereby draw the male member out of the first hub such that the flexible cover relaxes to the folded loose state.

15. An umbrella canopy having an open flexed shape and a closed relaxed shape, the umbrella canopy having an exterior and interior, the umbrella canopy comprising:

a) a first hub having an outer portion on a crown of the umbrella canopy and an inner portion on the interior of the umbrella canopy;

b) a second hub in the interior of the umbrella canopy, the second hub drawable to and away from the first hub, the second hub engageable to and disengageable from the first hub;

c) a set of at least three long ribs radially extending from the first hub, each of the long ribs having a proximal end, a distal end and an intermediate section therebetween, each of said proximal ends of the long ribs pivotally engaged to said first hub, the long ribs having a flexed state when the umbrella canopy is in the open flexed shape and a relaxed state when the umbrella canopy is in the closed relaxed shape;

d) a set of at least three short ribs radially extending from the second hub, each of the short ribs having a proximal end and a distal end, each of the proximal ends of the short ribs pivotally engaged to the second hub, each of the distal ends of the short ribs pivotally engaged to the intermediate section of one of said long ribs;

e) a flexible cover engaged to the long ribs and extending generally from the first hub to generally said distal ends of the long ribs, the flexible cover having generally a concave taut state when the long ribs are in the flexed state and a folded loose state when the long ribs are in the relaxed state;

f) a line having a proximal end and a distal end, the distal end of the line being engaged to the second hub, the line extending through the first hub, the proximal end of the line being disposed outside the interior of the umbrella canopy such that the proximal end of the line can be pulled to i) draw the second hub in the direction of the first hub such that the short ribs push against the main ribs and place the long ribs into the flexed state and ii) further draw the second hub in the direction of the first hub until the second hub engages the first hub to lock the long ribs in the flexed state and the flexible cover in the concave taut state;

g) wherein one of the first and second hubs includes an elongated extension with an annular oblique face adjacent to an annular channel; and h) wherein the other of the first and second hubs includes a pair of opposed transversely sliding members that are normally biased toward each other;

i) such that, when the elongated extension of one of the first and second hubs is pushed into the other of the first and second hubs, the annular oblique face of the elongated extension urges apart the opposed transversely sliding members until the elongated extension travels a given distance, whereupon said normal bias snaps the opposed transversely sliding members into the annular channel of the elongated extension to engage the first and second hubs to each other.

* * * * *